US008151991B2

(12) United States Patent
Ehrlich

(10) Patent No.: US 8,151,991 B2
(45) Date of Patent: Apr. 10, 2012

(54) METHOD AND SYSTEM FOR PROVIDING A THREE DIMENSIONAL STORED VALUE TOKEN THAT CONTAINS MOVABLE CONSUMER GOODS

(75) Inventor: Nathan Ehrlich, Duluth, GA (US)

(73) Assignee: Home Depot U.S.A., Inc., Atlanta, GA (US)

( * ) Notice: Subject to any disclaimer, the term of this patent is extended or adjusted under 35 U.S.C. 154(b) by 172 days.

(21) Appl. No.: 12/549,915

(22) Filed: Aug. 28, 2009

(65) Prior Publication Data

US 2011/0048979 A1 Mar. 3, 2011

(51) Int. Cl.
*B65D 83/04* (2006.01)

(52) U.S. Cl. ..... 206/540; 206/528; 206/459.5

(58) Field of Classification Search ..... 206/528, 206/530, 540, 308.2, 387, 11, 459.5, 459.1; 220/832, 837, 839
See application file for complete search history.

(56) References Cited

U.S. PATENT DOCUMENTS 2,655,259 A * 10/1953 Davoren ..... 225/43
3,749,230 A * 7/1973 Foster ..... 206/1.5
3,894,655 A * 7/1975 Mattheis et al. ..... 220/283
3,899,073 A * 8/1975 Barr ..... 206/77.1
3,954,179 A * 5/1976 Warmath ..... 206/528
3,968,880 A * 7/1976 Ostrowsky ..... 206/540
4,730,731 A * 3/1988 Allison ..... 206/540
4,757,901 A * 7/1988 Woods ..... 206/575
5,046,609 A * 9/1991 Mangini et al. ..... 206/232
5,752,615 A * 5/1998 Hofmann et al. ..... 220/324
5,958,536 A * 9/1999 Gelsinger et al. ..... 428/40.1
6,516,950 B1 * 2/2003 Robertson ..... 206/539
6,666,378 B2 12/2003 Davila et al.
7,222,797 B2 5/2007 Davila et al.
7,264,155 B2 9/2007 Halbur et al.
7,275,683 B2 10/2007 Lazarowicz et al.
7,314,179 B1 1/2008 Halbur et al.
7,438,224 B1 10/2008 Jensen et al.
7,445,157 B2 11/2008 Clegg et al.
7,623,040 B1 * 11/2009 Cote ..... 340/572.8
2002/0040937 A1 * 4/2002 Wu et al. ..... 235/493
2002/0088855 A1 7/2002 Hodes
2002/0117405 A1 * 8/2002 Wang et al. ..... 206/5.1
2003/0098257 A1 * 5/2003 Robertson ..... 206/538
2003/0230501 A1 12/2003 Smolev
2004/0007868 A1 1/2004 Werling
2005/0060269 A1 3/2005 Gaikoski
2005/0092763 A1 * 5/2005 Haggerty et al. ..... 220/912
2005/0182652 A1 * 8/2005 McIntyre et al. ..... 705/1
2005/0229450 A1 10/2005 Larsen et al.
2005/0274644 A1 * 12/2005 Williams-Hartman ..... 206/531
2006/0186196 A1 8/2006 Schultz et al.
2007/0051797 A1 3/2007 Randolph-Wall et al.
2007/0200000 A1 8/2007 Sanders
2007/0235350 A1 * 10/2007 Warlick ..... 206/37

(Continued)

*Primary Examiner* — David Fidei
(74) *Attorney, Agent, or Firm* — Smith Risley Tempel Santos LLC; Michael J. Tempel

(57) ABSTRACT

A method and system provides a stored value token that includes a three dimensional, closed volume which can include a movable cover for allowing access to the closed volume. The closed volume can contain various movable objects such as consumer goods, like plant seeds, edible food stuffs like mints, and/or utilitarian objects that can be used by the consumer such as screws, nails, nuts, bolts, etc. The closed volume can comprise human readable printed media on one side that identifies the volume as a stored value card and that identifies the contents being contained within the closed volume.

19 Claims, 8 Drawing Sheets

U.S. PATENT DOCUMENTS

2007/0266605 A1 11/2007 Halbur et al.
2008/0119952 A1 5/2008 Smith et al.
2008/0142383 A1* 6/2008 Hoogland et al. ..... 206/307
2008/0149727 A1 6/2008 Boyd et al.
2008/0223939 A1 9/2008 Halbur et al.
2008/0245875 A1 10/2008 Holt et al.

* cited by examiner

METHOD AND SYSTEM FOR PROVIDING A THREE DIMENSIONAL STORED VALUE TOKEN THAT CONTAINS MOVABLE CONSUMER GOODS

FIELD OF INVENTION

The invention generally relates to stored value tokens. More particularly, the invention relates to a stored value token having a three dimensional volume that contains movable consumer goods.

BACKGROUND

Stored value tokens that include, but are not limited to, gift cards, are often purchased such that the intended recipient of the gift card may use the value associated with the gift card to purchase one or more consumer products. When an intended recipient receives a gift card, the recipient may not have an immediate idea of what consumer product he or she may want to purchase with the gift card.

On some occasions the intended recipient of a gift card may know immediately what he or she may want to purchase with the gift card. However, later, when the gift card recipient steps inside the store associated with the gift card, the recipient may forget his or her previous idea for use of the gift card.

In other instances, gift cards may be sold without any suggestion of the consumer goods which may be purchased with the gift cards. Further, gift cards are often sold without providing any direct value to the consumer other than what value may be in the stored value account associated with the gift card.

Accordingly, there is a need in the art for a method and system that includes a stored value token which suggests products that may be purchased using the gift card while also providing direct value to the consumer in the form of one or more consumer goods. There is a further need in the art for a method and system that includes a stored value token that can store consumer goods which may be used by the token recipient.

SUMMARY

A stored value token can include a three dimensional, rectangular shaped closeable volume. The closeable volume can have a length, width, and a first thickness, the length being substantially greater than the width, the length and width being substantially greater than the first thickness, and the closeable volume has first and second planar, two dimensional surfaces defined by the length and width. The closeable volume can include human-readable media positioned on the first planar two dimensional surface, while the closeable volume has machine-readable media positioned on the second planar two dimensional surface.

The token can comprise a three dimensional, rectangular shaped closeable volume, the closeable volume having a length, width, and a first thickness, the length being substantially greater than the width, the length and width being substantially greater than the first thickness. The closeable volume has first and second planar, two dimensional surfaces defined by the length and width. The closeable volume comprises human-readable media positioned on the first planar two dimensional surface. The closeable volume also comprises machine-readable media positioned on the second planar two dimensional surface. The human readable media comprises one of text and illustrations that suggest products which can be purchased with the stored value token. The machine-readable media comprises one of a bar code, integrated circuit, a radio-frequency antenna, and a magnetic stripe.

The token also has a movable cover for allowing access to the closeable volume. The movable cover is attached to the closeable volume by a hinge. A plurality of movable objects are contained within the closeable volume, in which each movable object has a second thickness. The first thickness is greater than the second thickness and each movable object comprises a consumer good.

DETAILED DESCRIPTION

Figure 1A:
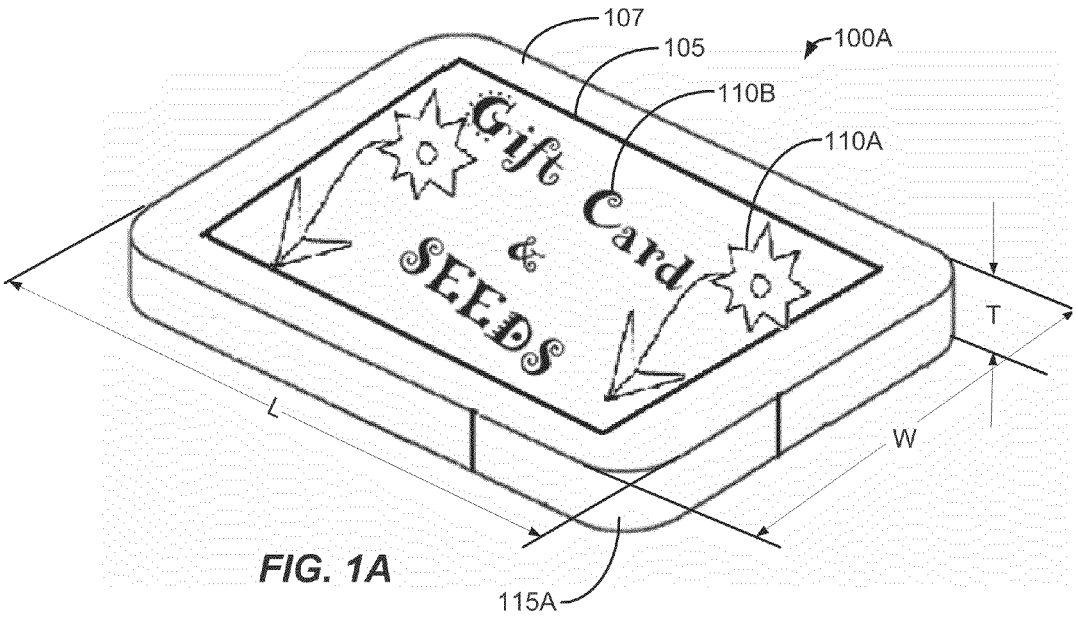
FIG. 1A illustrates a top, perspective view of a three dimensional stored value token according to an exemplary embodiment of the invention.

A method and system provides a stored value token that comprises a three dimensional, closed volume which can include a movable cover for allowing access to the closed volume. The closed volume can contain various movable objects such as consumer goods, like plant seeds, edible food stuffs like mints, and/or utilitarian objects, such as screws, nails, nuts, bolts, etc., that can be used by the consumer. The closed volume can comprise human readable printed media on one side that identifies the volume as a stored value card and that identifies the contents being contained within the closed volume. The printed media can be formed from ink, or other writing materials, which is placed on a substrate that is attached to the closed volume by an adhesive. Alternatively, the printed media can be applied directly to a surface of the closed volume or human readable information can be carved from, or otherwise applied to, a surface of the closed volume.

On a second side of the closed volume a machine-readable code can be applied to a substrate which is attached to the closed volume by an adhesive. The machine readable code can take the form of at least one of a bar code, a radio-frequency (RF) Identifier, a magnetic stripe, an integrated circuit (IC), or any combination thereof. The machine-readable code can comprise an identifier that corresponds to a stored value account. A purchaser of the stored value token can set the value in the stored value account associated with the stored value token or this value can be set in predetermined increments by the manufacturer. Once purchased by the consumer and after activation of the token, which can occur when the machine-readable code is scanned by a reader, the bearer of the stored value token can use the value in the stored value account to purchase goods or services based on the value in the stored value account associated with the token. The stored valued token can be replenished for re-use or it can be a one-time use token.

According to an exemplary embodiment, the three dimensional volume of the stored value token can comprise a movable, triangular shaped door that allows access to a rectangular parallel-piped shaped, closeable volume. The triangular shaped door can comprise one of the four corners of the rectangular parallel-piped shaped closeable volume. The triangular shaped door can be formed by two sides of the volume and a rear portion of the volume may support the machine-readable code for the token. The rear portion forming the triangular shaped door may further comprise a seam that functions as a hinge for the door. The door may rotate about this hinge to allow access to the closed volume. The closeable volume has a length, width, and thickness in which the thickness generally corresponds to height of the objects contained within the volume. The length and width of the closeable volume can be sized such that they correspond to a standard or traditional card size similar to other money instruments like credit cards, integrated circuit (IC or smart) cards, debit cards, and the like.

According to another exemplary embodiment, the three dimensional volume of the stored value token can comprise a movable, rectangular shaped door that allows access to a rectangular parallel-piped shaped closeable volume. The rectangular door can be fastened to the closeable volume by at least one hinge which is positioned along a side of the closeable volume. The rectangular door may have a thickness that is less than a thickness of the remaining parts which form the closeable volume. The door may rotate about the hinge to allow access to the closed volume. The closeable volume has a length, width, and thickness in which the thickness generally corresponds to a size which is at least double the height of the objects contained within the volume. The length and width of the closeable volume can be sized such that they correspond to a standard or traditional card size similar to other money instruments like credit cards, IC cards, debit cards, and the like.

Referring now to FIG. 1A, in which like reference numerals designate like elements, this figure illustrates a top, perspective view of a three dimensional stored value token 100A according to an exemplary embodiment of the invention. The three dimensional stored value token 100A may generally comprise a rectangular volume; however, other shapes are included within the scope of the invention. For example, the three dimensional stored value token 100A may comprise a cylindrical, square, or other geometrical shape.

The three dimensional stored value token 100A may be constructed from one or more various materials. For example, the embodiment of the stored value token 100A illustrated in FIG. 1A may be constructed entirely from plastic. However, other materials are included within the invention, such as metal, composites, paper, or any other natural and/or synthetic materials.

The three dimensional stored value token 100A may have a length dimension L, a width dimension W, and a thickness dimension T. The length L and width W generally correspond with the length and width of cards used in financial transactions. In other words, the length L and width W can be selected to correspond with standard sized financial cards like debit cards, integrated circuit (IC) cards, and credit cards as used in industry. The length L and width W can correspond with Format ID-1 of the International Organization for Standardization (ISO) and the International Electrotechnical Commission (ISO/IEC) standard 7810. This means that the length L can comprise a magnitude of about eighty-five millimeters and the width W can comprise a magnitude of about fifty-four millimeters.

The thickness dimension T can be selected such that it generally corresponds with a thickness of a movable object being contained within the three dimensional stored value token 100A. That is, the thickness dimension T may be selected such that it is slightly larger than a maximum thickness of the objects being contained within the three dimensional stored value token 100A. The relationship between the thickness dimension T and the movable objects being contained within the stored value token 100A is discussed in further detail below in connection with FIG. 1D. Dimensions greater than or less than the exemplary magnitudes for the length L, width W, and thickness T dimensions described above are within the scope of the invention.

Figure 11:
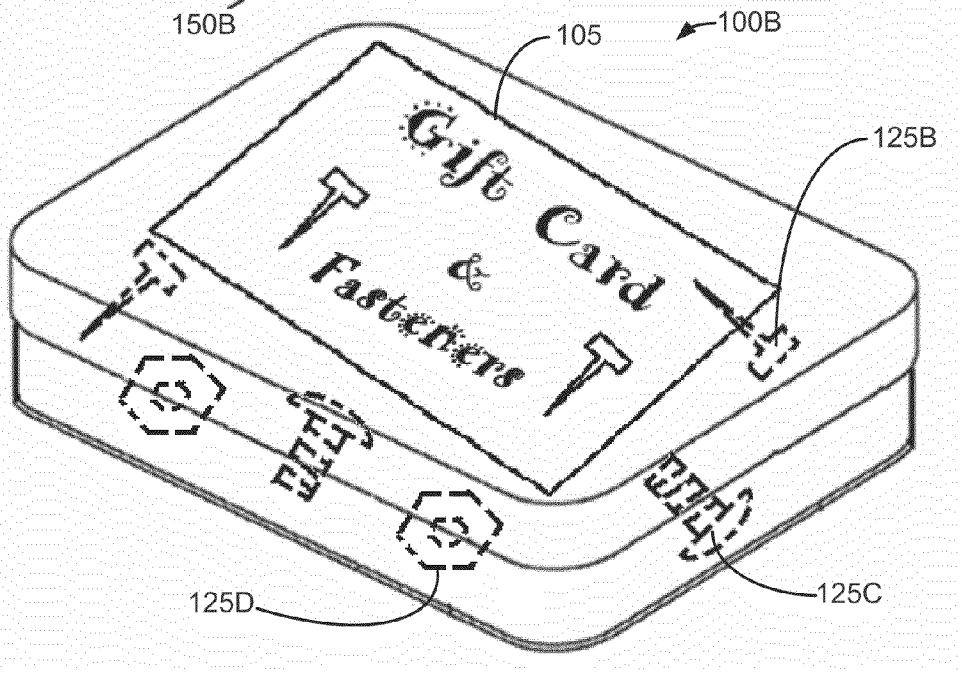
FIG. 11 illustrates a top, perspective view of a three dimensional stored value token with movable utilitarian consumer goods according to an exemplary embodiment of the invention.

The three dimensional stored value token 100A may comprise a label 105 that has human-readable media 110A, 110B. The first human-readable media 110A may identify a type of consumer goods that may be purchased with the three dimensional stored value token 100A in addition to identifying the movable objects being contained by the token 100A. In the exemplary embodiment illustrated in FIG. 1, the first human-readable media 110A comprises an illustration of a flower. Other movable objects, beyond seeds, are not beyond the scope of the invention as illustrated in FIG. 11 and discussed below.

The second human-readable media 110B may identify the invention as a stored value token 100A. However, other human-readable media 110 beyond those described for the label 105 are within the scope of the invention. The human-readable media 110 may be formed from ink or other marking media. The human-readable media 110 can be applied directly to a first surface or it may be applied to the label 105 that is attached to a first surface 107 of the three dimensional volume 100A. The human-readable media 110 can also be imprinted, stamped, or carved from a surface 107 of the three dimensional stored value token 100A.

The three dimensional stored value token 100A may have a door 115A that allows access to the volume defined by the stored value token 100A. In the exemplary embodiment of FIG. 1A, the door 115 can generally comprise a corner portion of the rectangular-shaped volume of the stored value token 100A. Further details of the door 115A illustrated in FIG. 1A will be described below in connection with FIG. 1C. The door 115A of the stored value token 100A is not limited to the one illustrated in FIG. 1A and my include other types and shapes. For example, see the rectangular shaped door 115B of the exemplary embodiment illustrated in FIGS. 3 and 4 described below.

Figure 1B:
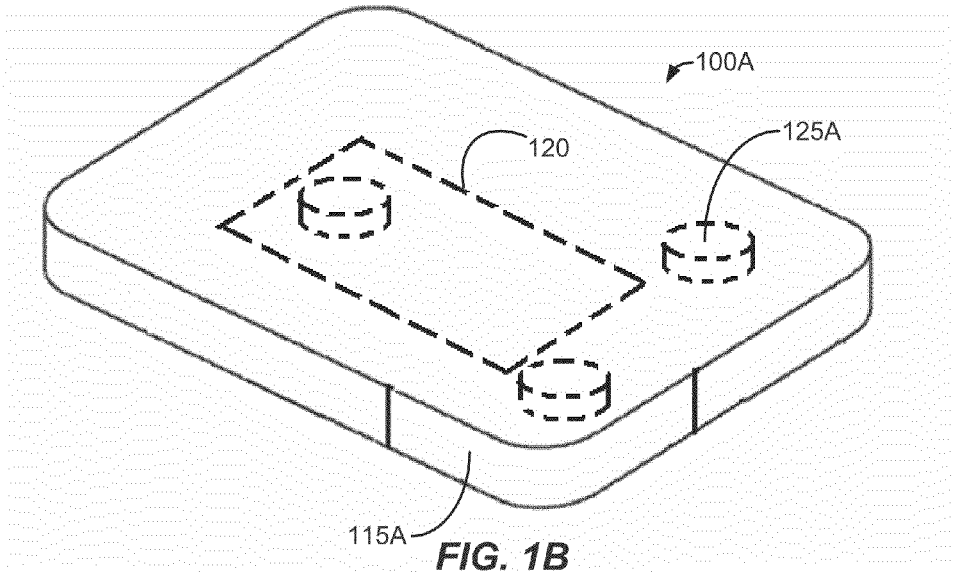
FIG. 1B illustrates a top, perspective view of a three dimensional stored value token and a machine-readable code positioned on a rear surface of the token according to an exemplary embodiment of the invention.

FIG. 1B illustrates a top, perspective view of a three dimensional stored value token 100A and a machine-readable code 120 positioned on a rear surface of the token 100A according to an exemplary embodiment of the invention. The machine-readable code 120 is illustrated with dashed lines to indicate that it is hidden from the perspective view of FIG. 1B.

FIG. 1B further illustrates the movable objects 125A that can be contained within the volume defined by the three dimensional token 100A. The movable objects 125A of FIG. 1B may comprise consumer goods, like seeds, that have generally cylindrical shapes. Movable objects 125A include those items which can move freely within the volume defined by the three dimensional token 100A. However, the invention may include and contain objects which are not movable meaning that the objects 125A may be secured by packaging material or that they are so tightly packed that their movement within the volume of the token 100A is restricted.

As noted above, the movable objects 125A are not limited to consumer goods and particularly to seeds. Other consumer goods include, but are not limited to, edible food stuffs like mints, gum, and/or utilitarian objects that can be used by the consumer such as screws, nails, nuts, bolts, needles, tacks, washers, etc. In view of the various objects that can be contained within the closed volume defined by the stored value token 100A, it is understood that the shapes of the objects 125A are not limited to the cylindrical shapes representing the seeds and may have numerous shapes without departing from the invention.

Figure 1C:
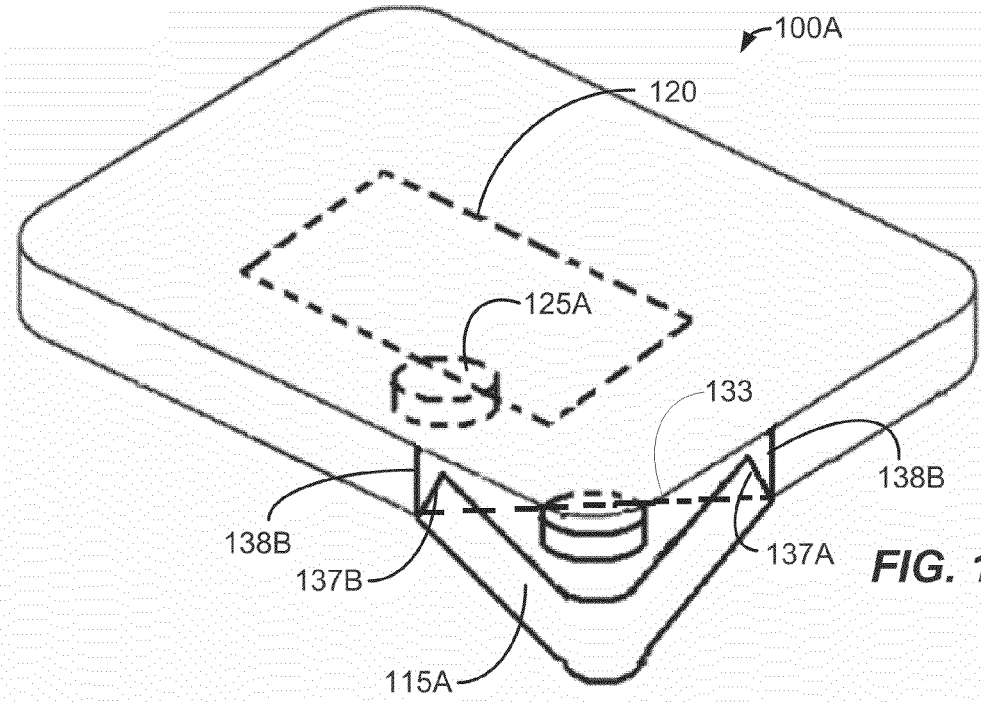
FIG. 1C illustrates a top, perspective view of a three dimensional stored value token and a movable, triangular door in an open position according to an exemplary embodiment of the invention.

FIG. 1C illustrates a top, perspective view of a three dimensional stored value token 100A and a movable, triangular door 115A in an open position according to an exemplary embodiment of the invention. The triangular door 115A rotates about a diagonal seam 133 illustrated with dashed lines in FIG. 1C to indicate it is hidden in the current view. The diagonal seam 133 is connected to the same surface that bears the machine-readable code 120, which is also illustrated with dashed lines to indicate that the code 120 is also hidden from the view shown in FIG. 1C.

The diagonal seam 133 illustrated in FIG. 1C allows walls 137A,B of the triangular door 115A to move away from walls 138A, B of the three dimensional stored value token 100A. In this manner, access to the volume defined by the remaining non-movable portions of the three dimensional stored value token 100A can be accomplished so that one or more movable objects 125A can be removed from or inserted into the volume. The exemplary embodiment illustrated in FIG. 1C is preferably made from plastic. The diagonal seam 133 is also made from plastic. As noted previously, the three dimensional stored value token 100A can be made from other materials besides plastic, such as metal, composites, or other materials.

Figure 1D:
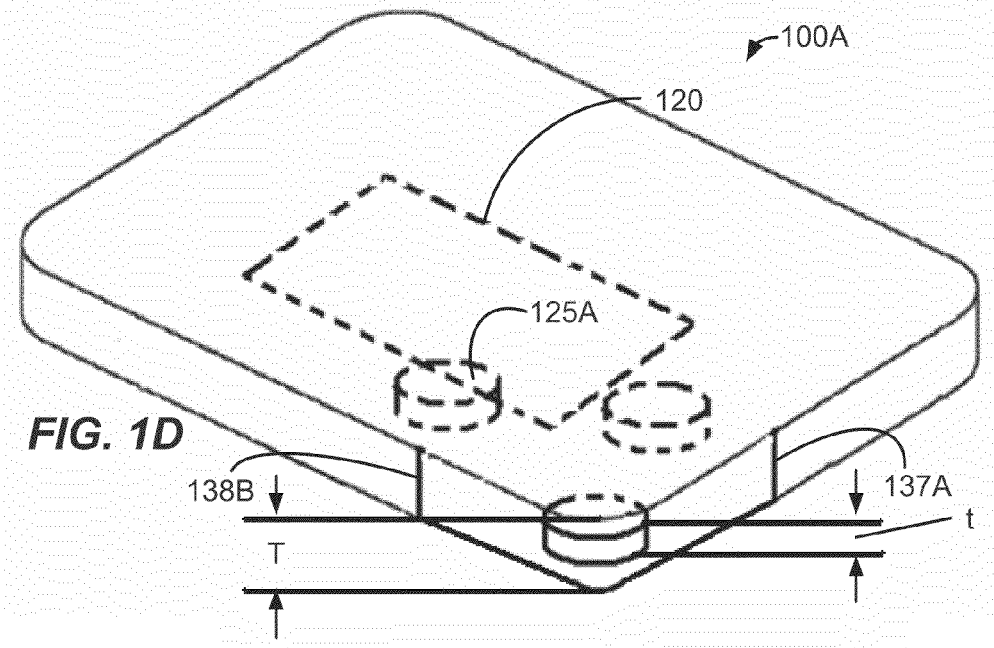
FIG. 1D illustrates a top, perspective view of a three dimensional stored value token and with a movable, triangular door removed from view according to an exemplary embodiment of the invention.

FIG. 1D illustrates a top, perspective view of a three dimensional stored value token 100A and with a movable, triangular door 115A removed from view according to an exemplary embodiment of the invention. In this view, the thickness dimension T of the stored value token 100A is compared to a thickness dimension t for the movable object 125A contained within the volume defined by the stored value token 100A. The thickness t for the object 125 is generally very close or similar to the thickness T for the stored value token 100A.

For example, the thickness dimension t for the object 125A can comprise a magnitude of about 3/32 of an inch while the thickness dimension T for the stored value token 100A can comprise a magnitude of about 6/32 of an inch. The ratio defined by these magnitudes for the object thickness t to the stored value token thickness T is approximately 1:2. However, other dimensions and ratios smaller or greater than these exemplary magnitudes are within the scope of the invention. Each object 125A may have a different magnitude for its thickness dimension t such that there can be several magnitudes for the thickness dimension t. But all magnitudes for the thickness dimension t are less than the thickness dimension T for the stored value token 100A. This discussion of the thickness t for each object 125A may apply to all embodiments discussed in this specification.

Figure 2:
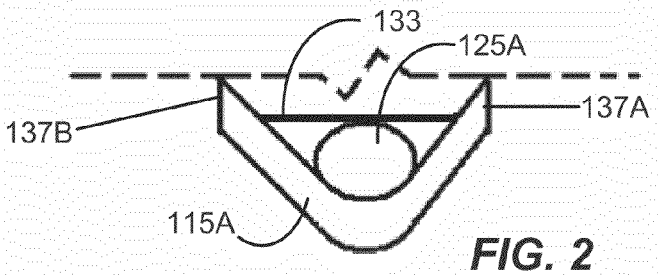
FIG. 2 illustrates a top view of a movable, triangular door according to an exemplary embodiment of the invention.

FIG. 2 illustrates a top view of a movable, triangular door 115A according to an exemplary embodiment of the invention. The triangular door 115A can be sized such that only one movable object 125A may be dispensed at a time through the door 115A. As noted previously, the triangular door 115A may rotate about the seam 133 such that walls 137A,B move relative to the remaining portions of the volume defined by the three dimensional stored value token 100A. The invention is not limited to a triangular shaped door 115A. The door 115A may comprise other shapes, such as, but not limited to, rectangular, square, oval, and other geometrical shapes.

Figure 3:
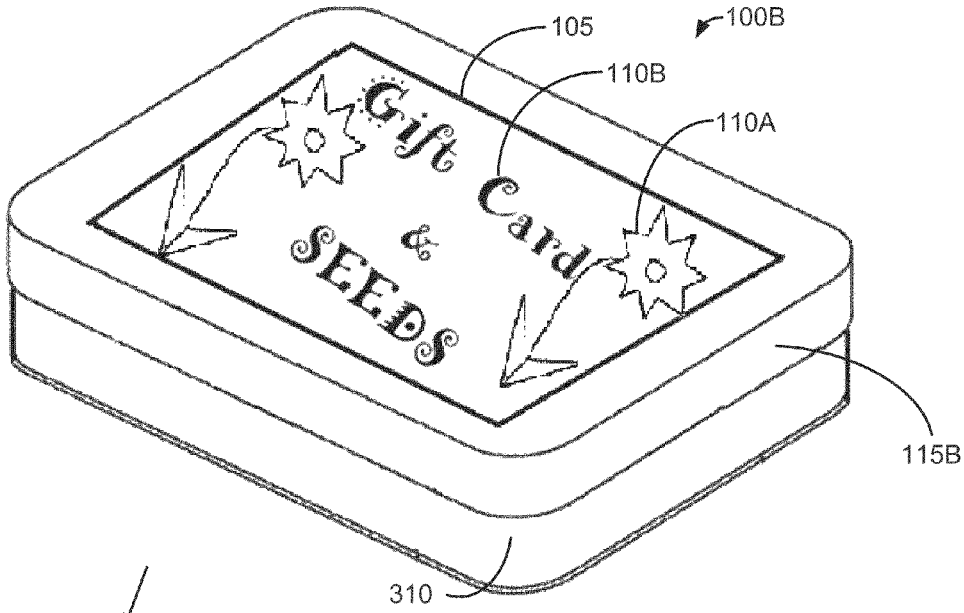
FIG. 3 illustrates a top, perspective view of a three dimensional stored value token with a movable rectangular door in a closed position according to an exemplary embodiment of the invention.

FIG. 3 illustrates a top, perspective view of a three dimensional stored value token 100B with a movable rectangular door 115B in a closed position according to an exemplary embodiment of the invention. The rectangular door 115B allows full access to the remaining portion 305 of the three dimensional stored value token 100B. Relative to the exemplary embodiment illustrated in FIGS. 1-2, the exemplary embodiment of FIG. 3 allows multiple objects 125 to be inserted and/or removed as illustrated in further detail in FIG. 4 described below.

The exemplary embodiment illustrated in FIG. 3 can have a length and width similar to the embodiment illustrated in FIG. 1. That is, the length and width of the stored value token 100B can be selected to correspond with standard sized financial cards like debit cards, integrated circuit (IC) cards, and credit cards as used in industry. The length L and width W can correspond with Format ID-1 of the International Organization for Standardization (ISO) and the International Electrotechnical Commission (ISO/IEC) standard 7810 as described above for the exemplary embodiment illustrated in FIG. 1.

In the exemplary embodiment illustrated in FIG. 3, the stored value token 100B is preferably made from metal. However, as noted above, other materials, such as plastics, composites, and the like are included within the scope of the invention. The shape of the volume defined by the three dimensional token 100B is rectangular. However, other geometrical shapes such as oval, cylindrical, parallel-piped, and the like are within the scope of the invention.

Figure 4:
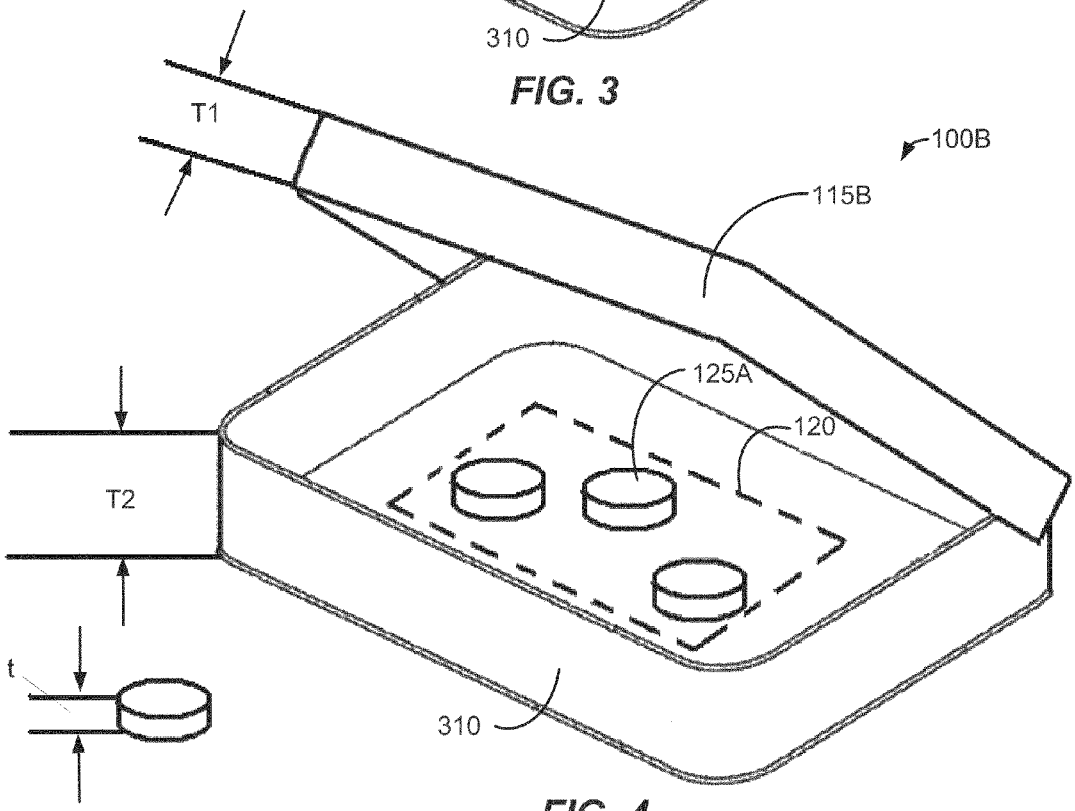
FIG. 4 illustrates a top, perspective view of a three dimensional stored value token with a movable rectangular door in an open position according to an exemplary embodiment of the invention.

FIG. 4 illustrates a top, perspective view of a three dimensional stored value token 100B with a movable rectangular door 115B in an open position according to an exemplary embodiment of the invention. In this exemplary embodiment, the movable objects 125A within the closeable volume defined by the door 115B and portion 310 are visible. The machine readable code 120 is illustrated with dashed lines to indicate that it is hidden from this view.

The door 115B has a first thickness dimension T1 while the remaining portion 310 of the token 100B can have a second thickness dimension T2. The first thickness T1 can have an exemplary magnitude of about 5/32 of an inch. The second thickness T2 can have an exemplary magnitude of about 25/32 of an inch. This means that, for this exemplary embodiment, the first thickness T1 has a thickness which is approximately one-fifth of the thickness T2 of portion 310. However, other magnitudes greater or less than those described above for the first and second thickness dimensions T1 and T2 are within the scope of the invention.

Meanwhile, the thickness t for the movable objects 125 as described above can have a magnitude of about 3/32 of an inch. This means the second thickness T2 dimension for the stationary portion 310 has a magnitude which is approximately eight times greater than the magnitude for the object thickness dimension t. However, other magnitudes greater or less than those described above for the thickness dimensions T2 and t are within the scope of the invention.

Figure 5:
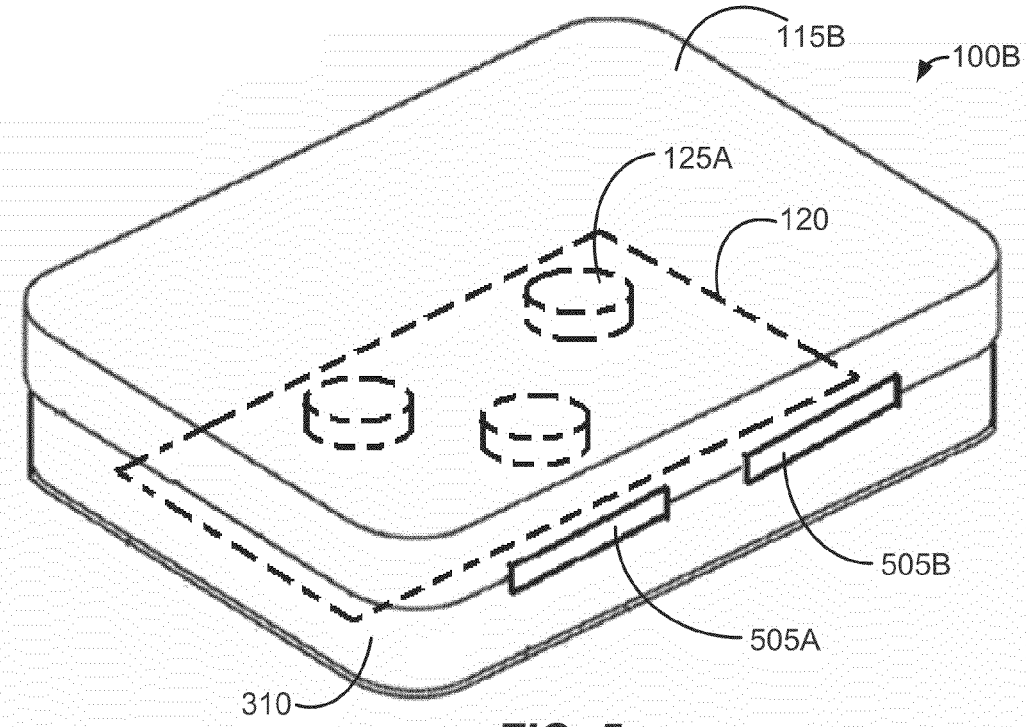
FIG. 5 illustrates a top, perspective view of a three dimensional stored value token with a movable rectangular door fastened to the token with hinges according to an exemplary embodiment of the invention.

FIG. 5 illustrates a top, perspective view of a three dimensional stored value token 100B with a movable rectangular door 115B fastened to the token 100B with hinges 505 according to an exemplary embodiment of the invention. Specifically, the rectangular door 115B can be fastened to the stationary portion 310 by a first hinge 505A and a second hinge 505B. Any one of a number of different types of hinges can be used and are within the scope of the invention. For example, the hinges 505 can comprise butt hinges, butterfly hinges, barrel hinges, flush hinges, and the like. The hinges 505 can be integral or made as part of the door 115B and stationary portion 310 or they can be separately manufactured and attached.

The hinges 505A, 505B can secure one end of the rectangular door 115B to the stationary portion 310 of the three dimensional stored value token 100B. The invention is not limited to the number of hinges 505 illustrated. The invention can include a fewer number or a greater number of hinges than the number illustrated. Further details of the hinges 505 will be described below in connection with FIGS. 7A-7B.

Figure 6:
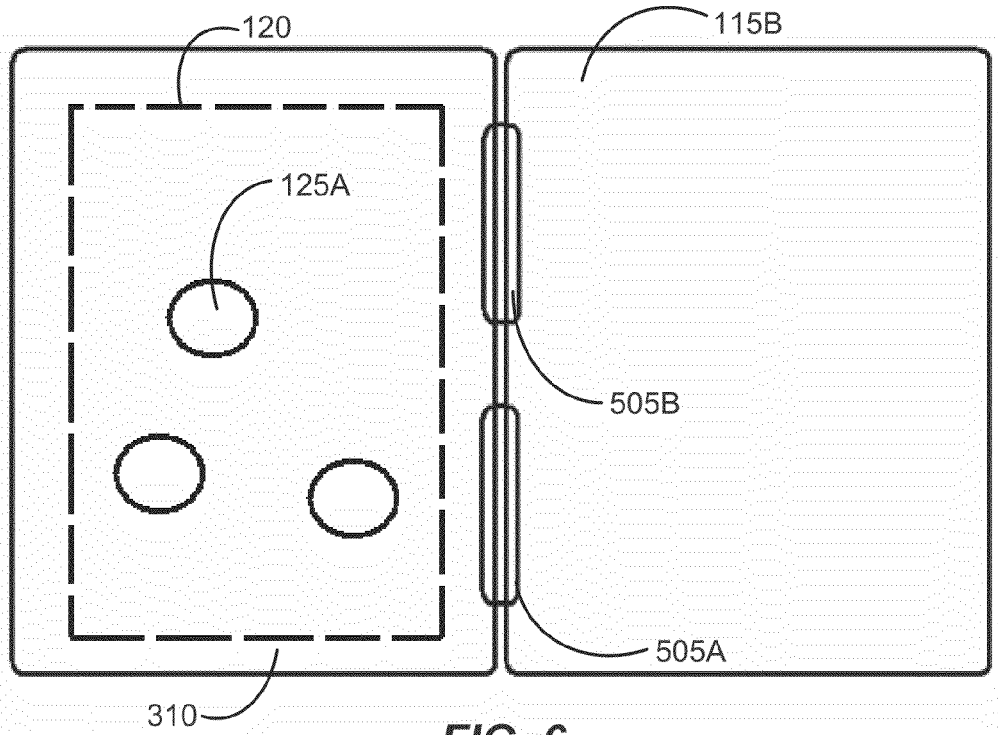
FIG. 6 illustrates a top view of a three dimensional stored value token with a movable rectangular door in an open position exposing a major, stationary portion of the volume formed by the token according to an exemplary embodiment of the invention.

FIG. 6 illustrates a top view of a three dimensional stored value token 100B with a movable rectangular door 115B in an open position exposing a major stationary portion 310 of the volume formed by the token 100B according to an exemplary embodiment of the invention. In this view, the machine-readable code 120 is again illustrated with dashed lines to indicate that it is hidden in this view.

The machine-readable code 120 is illustrated with a rectangular in shape to denote a label which may receive printed media comprising the code 120. The code 120 is also illustrated with a certain size relative to the stationary portion 310. The code 120 can have sizes and shapes other than those illustrated. Similarly, while only three objects 125A are illustrated in FIG. 6, a number of objects 125A greater or less than this magnitude is within the scope of the invention.

Figure 7A:
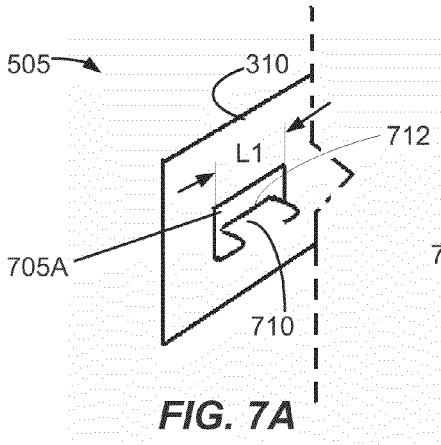
FIG. 7A illustrates an exemplary hinge for a three dimensional stored value token according to an exemplary embodiment of the invention.

FIG. 7A illustrates an exemplary hinge for a three dimensional stored value token 100B according to an exemplary embodiment of the invention. As noted above, any one of a number of different types of hinges 505 can be used and are within the scope of the invention. For example, the hinges 505 can comprise butt hinges, butterfly hinges, barrel hinges, flush hinges, and the like.

For the exemplary embodiment illustrated in FIG. 7A, the hinge 505 comprises a section of the stationary portion 310 of the token 100B which includes a first opening or aperture 705A and a curved member 710. The curved member 710 can be designed such that it has an end 712 which projects into a geometric plane defined by the first aperture 705A. The curved member 710 can engage a linear member 715 illustrated in FIG. 7B. The first aperture 705A may have a length dimension L1.

Figure 7B:
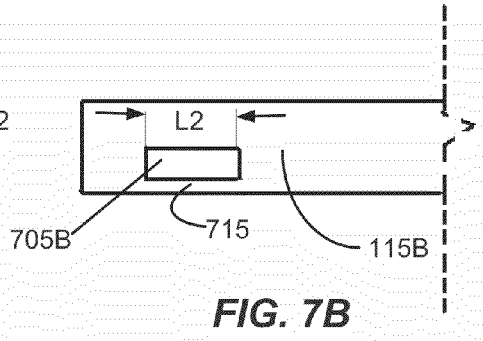
FIG. 7B illustrates an exemplary aperture for receiving the hinge of FIG. 7A for a three dimensional stored value token according to an exemplary embodiment of the invention.

Referring now to FIG. 7B, this figure illustrates an exemplary aperture 705B for receiving the hinge 505 of FIG. 7A for a three dimensional stored value token 100B according to an exemplary embodiment of the invention. The exemplary aperture 705B is a second aperture relative to the first aperture 705A of FIG. 7A. The second aperture 705B may have a length dimension L2. According to this exemplary embodiment, the length dimension L2 is greater than the length dimension L1 of the first aperture 705A. Adjacent to the second aperture 705B is a linear member 715 which engages the curved member 710 of FIG. 7A.

Figure 8:
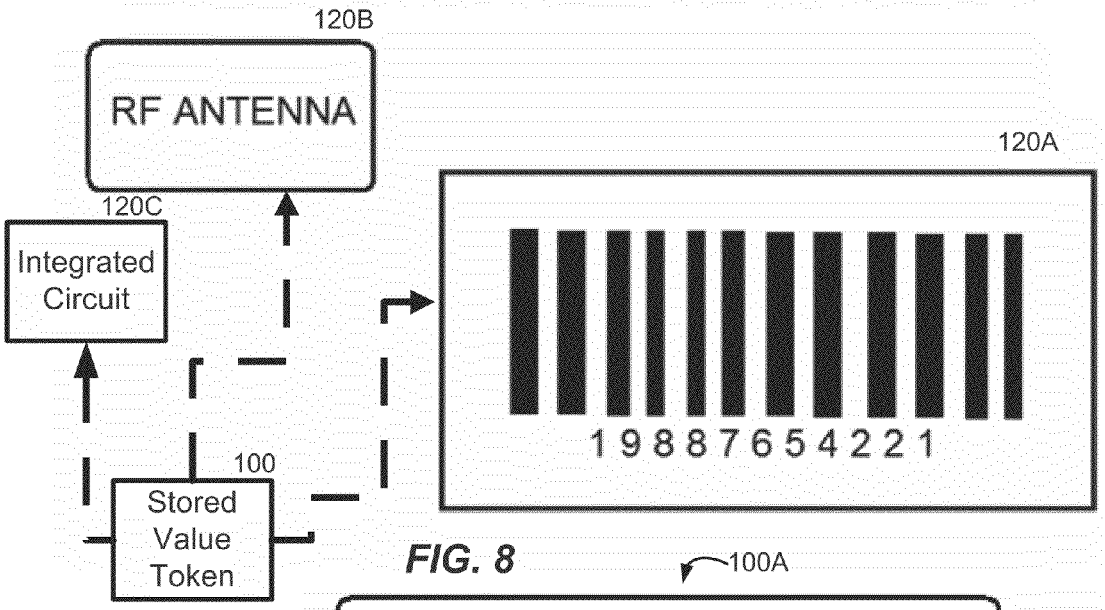
FIG. 8 illustrates various exemplary embodiments of the machine readable code for the stored value token according to the invention.

FIG. 8 illustrates various exemplary embodiments of the machine readable code 120 for the stored value token 100 according to the invention. The machine-readable code 120 can take on one or more different types of forms. For example, the machine-readable code 120A can comprise a bar-code. The machine readable code 120B can comprise an RF antenna coupled to an integrated circuit or chip or the RF antenna can be tuned to a particular unique frequency. Alternatively, the machine-readable code 120C can comprise an integrated circuit (IC) such as an IC circuit for an IC card. The machine-readable code 120 can take the form of any one or any combination of these exemplary codes 120.

Figure 9:
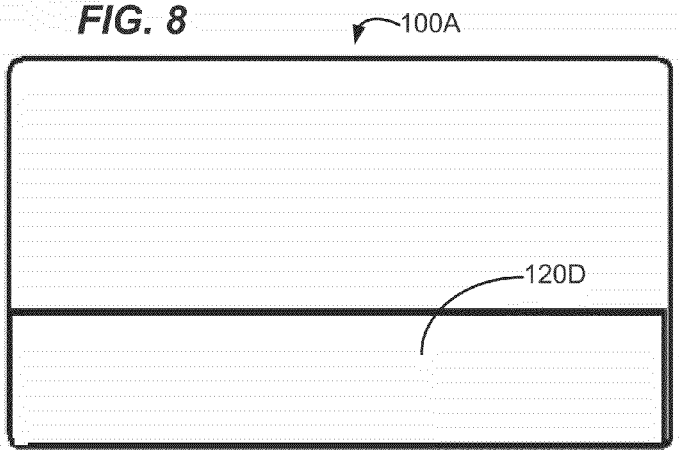
FIG. 9 illustrates a magnetic stripe for the machine readable code according to an exemplary embodiment of the invention.

FIG. 9 illustrates a magnetic stripe for the machine readable code 120D according to an exemplary embodiment of the invention. The magnetic stripe machine-readable code 120D can be positioned on the stationary portion 310 of the embodiment of FIG. 3 or on planar surface defined by the length L and width W of the embodiment illustrated in FIG. 1A.

Figure 10:
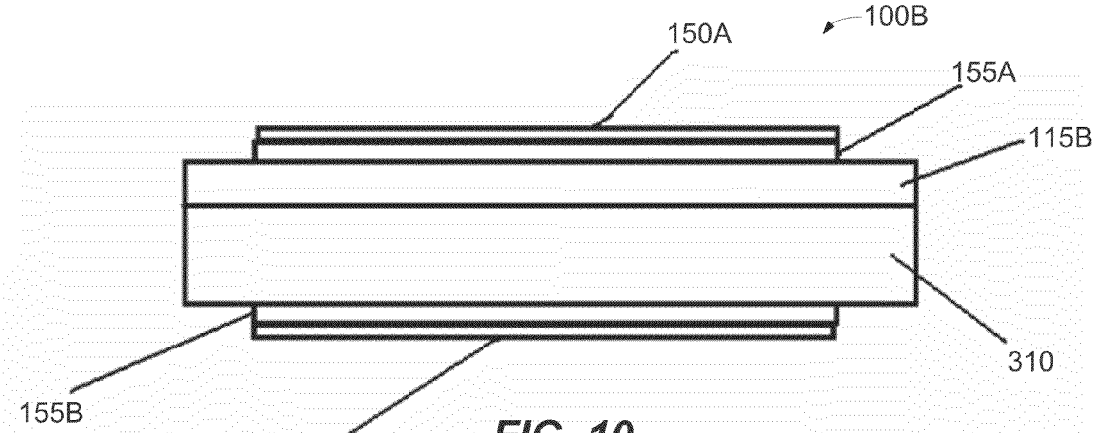
FIG. 10 illustrates a cross-sectional view of the three dimensional stored value token of FIG. 3 according to an exemplary embodiment of the invention.

FIG. 10 illustrates a cross-sectional view of the three dimensional stored value token 100B of FIG. 3 according to an exemplary embodiment of the invention. In this view of the token 100B, the thicknesses of the various parts of the token 100B are not drawn to scale so that the various parts can be easily seen. A first substrate 150A that supports the human-readable media 110A, 110B (not shown) is coupled to a surface of the first cover 115A with first adhesive 155A. Similarly, a second substrate 150B supporting the machine-readable code 120 (not shown) is coupled to a surface of the stationary portion 310 with a second adhesive 155B. The first adhesive 155A and second adhesive 155B can be the same or different types of adhesives.

FIG. 11 illustrates a top, perspective view of a three dimensional stored value token 100B with movable utilitarian consumer goods 125B-D according to an exemplary embodiment of the invention. As noted previously, the movable objects 125 can comprise consumer goods, like utilitarian consumer goods that can be used by the consumer such as screws 125C, nails 125B, nuts 125D, bolts, etc. The utilitarian consumer goods 125B-D are illustrated with dashed lines in this figure to signify that they are hidden from view in this figure. These types of consumer goods can suggest the type of goods which may be purchased by the user of the three dimensional stored value token 100B. The volume defined by the three dimensional stored value token 100B may comprise only one type of consumer goods 125 or any combination thereof.

Figure 12:
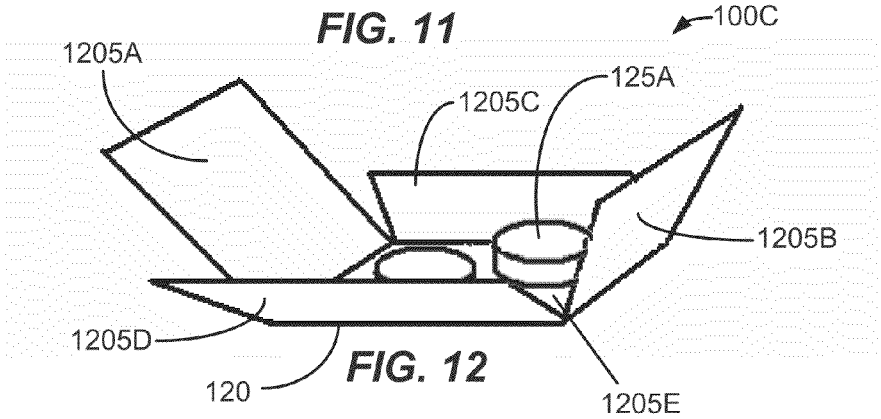
FIG. 12 illustrates a top, perspective view of a three dimensional stored value token formed from a single, folded substrate according to an exemplary embodiment of the invention.

FIG. 12 illustrates a top, perspective view of a three dimensional stored value token 100C formed from a single, folded substrate 1205 according to an exemplary embodiment of the invention. The substrate 1205 may comprise four foldable sides 1205A, 1205B, 1205C, and 1205D. The volume of the three dimensional stored value token 100C can be formed when the four sides 1205A, 1205B, 1205C, and 1205D are positioned to form an enclosure. The sides 1205 can be fastened together with an adhesive when they are in a closed position.

The machine-readable code 120 can be positioned on a side 1205E which remains stationary relative to the other four foldable sides 1205A, 1205B, 1205C, and 1205D. While only four foldable sides 1205 have been illustrated, the invention may include a fewer number or a greater number of foldable sides 1205 without departing from the scope of the invention. Further, while the foldable sides 1205 have been illustrated as a single unitary member, the invention can include sides 1205 which are separate from one another but which are glued together to form the enclosure. The material for the substrate 1205 can comprise paper. However, other materials, such as, but not limited to, metal, plastic, rubber, composites, and the like are included within the scope of the invention.

Figure 13:
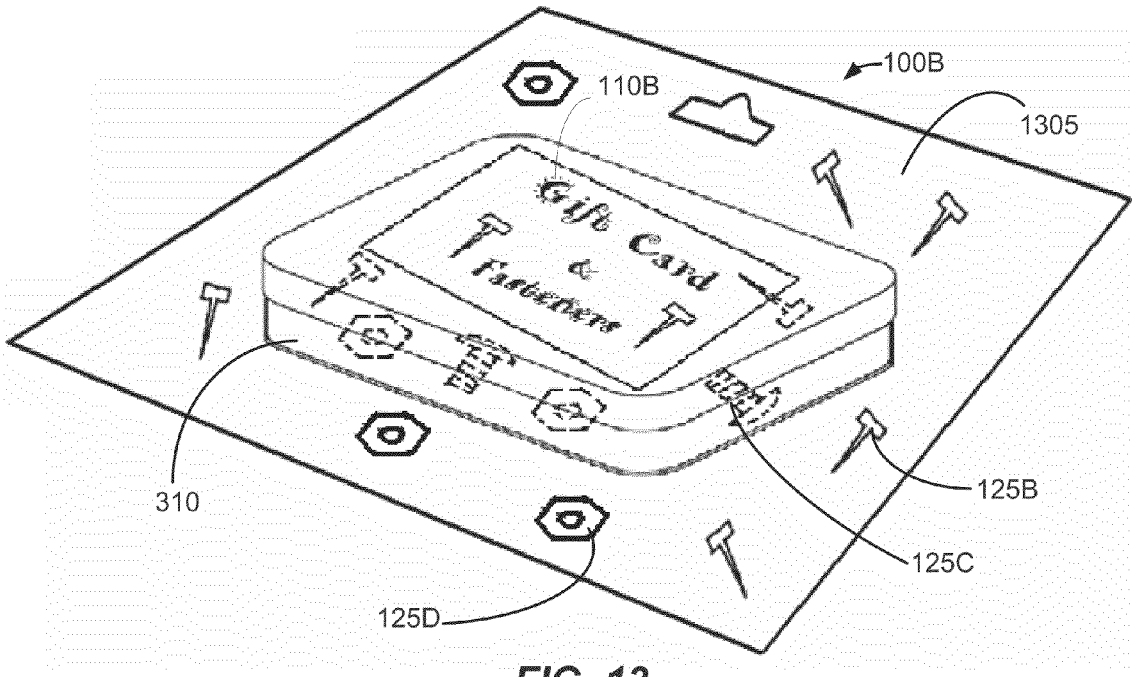
FIG. 13 illustrates a three dimensional stored value token fastened to display media for retail sale according to an exemplary embodiment of the invention.

FIG. 13 illustrates a three dimensional stored value token 100B fastened to display media 1305 for retail sale according to an exemplary embodiment of the invention. The display media 1305 can comprise a planar surface made from materials similar to those used for substrate embodiment illustrated in FIG. 12. The display media 1305 can further support human-readable media, similar to the human-readable media 110A on the stored value token 100. The three dimensional stored value token 100B can be fastened to the display media 1305 by an adhesive which does not damage or mar the stationary portion 310. After the three dimensional stored value token 100B is purchased, the stored value token 100B can be removed from display media 1305.

Figure 14:
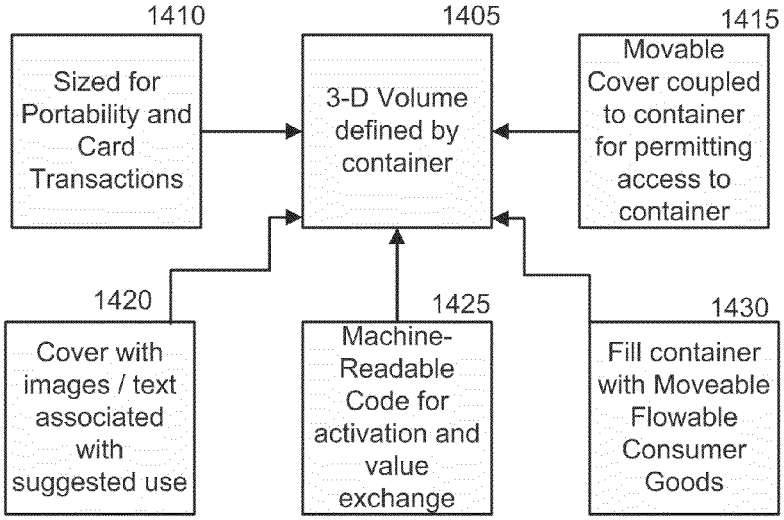
FIG. 14 is a functional block diagram of the three dimensional stored value token according to an exemplary embodiment of the invention.

FIG. 14 is a functional block diagram of the three dimensional stored value token 100D according to an exemplary embodiment of the invention. This figure highlights various features of the stored value token 100D. One of the main features of the invention includes the three dimensional volume defined by the container (Feature 1405). Another feature 1410 includes how the token 100D is sized for portability and for standard card transactions. An additional feature 1415 includes the moveable cover 115 for permitting access to the three dimensional volume. An additional feature 1430 is filling the three dimensional volume with movable consumer goods 125.

Further features of the token 100D include cover(s) with image(s) and/or text (feature 1420) associated with suggested use of the token 100D. The machine-readable code 120 that permits activation and value exchange is also a feature 1405 of the invention.

Figure 15:
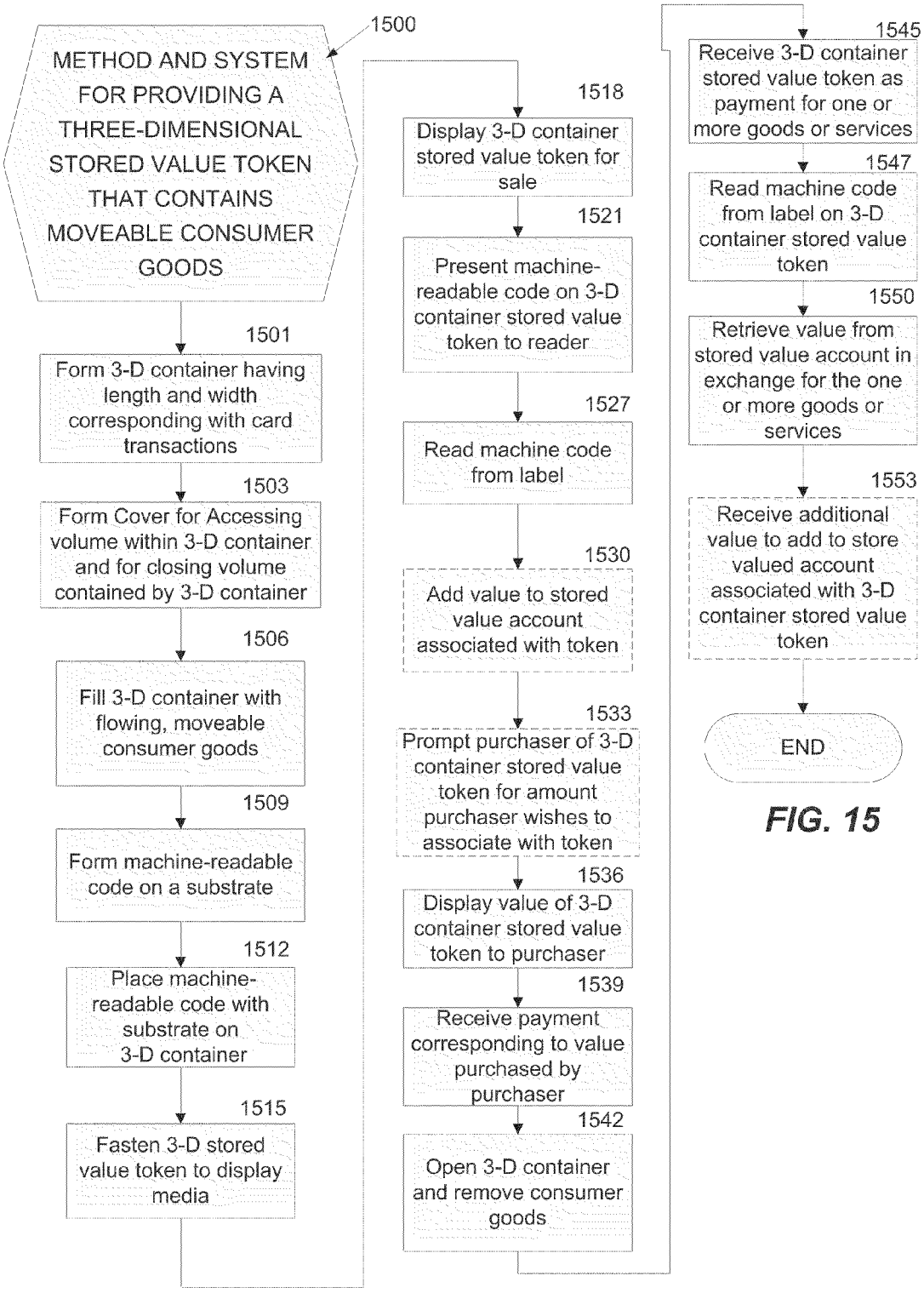
FIG. 15 is a logic flow diagram highlighting various steps of a method for making and using the three dimensional stored value token according to an exemplary embodiment of the invention.

FIG. 15 is a logic flow diagram highlighting various steps of a method 1500 for making and using the three dimensional stored value token according to an exemplary embodiment of the invention. Certain steps in the processes or process flow described in this specification must naturally precede others for the invention to function as described. However, the invention is not limited to the order of the steps described if such order or sequence does not alter the functionality of the invention. That is, it is recognized that some steps may performed before, after, or parallel other steps without departing from the scope and spirit of the invention. In some instances, certain steps can be deleted or not performed without departing from the invention.

Step 1501 is the first step of method 1500 in which a three-dimensional container having a length L and width W corresponding with card transactions can be formed. That is, as noted above, the length L and width W of the stored value token can be sized according to one or more standards, such as standard ID-1 of the international organization for standardization (ISO) and the international electrotechnical commission (IEC) 7810 standard.

In step 1503, a cover 115 for accessing the volume within the three-dimensional container can be formed. The cover 115 can also be used for closing the volume contained by the three-dimensional container.

In step 1506, the three-dimensional container can be filled with movable objects 125 that may include consumer goods. The consumer goods can include, but are not limited to, plant seeds, edible food stuffs like mints, and/or utilitarian objects that can be used by the consumer such as screws, nails, nuts, bolts, etc.

In step 1509, a machine readable code 120 can be formed on a substrate with an adhesive as illustrated in FIG. 10. The machine-readable code 120 can comprise a bar code 120A, an RF antenna 120B, an integrated circuit 120C, a magnetic stripe 120D, or any combination thereof. Alternatively, the machine-readable code 120 can be applied directly with a writing material, such as ink, to the surface of the token 100.

In step 1512, the machine-readable code 120 can be placed on the three dimensional container. Next, in step 1515, the three-dimensional token 100 can be fastened to display media 1305. The token 100 can be fastened to the display media 1305 with an adhesive or by a mechanical device, such as by cutouts in the display media 1305 that receive one or more corners of the stored value token 100.

In step 1518, the three dimensional stored value token 100 can be displayed for sale in a traditional store environment or on-line. If the three dimensional stored value token 100 is selected for purchase, the machine-readable code 120 is presented to a reader in step 1521. The reader can take on one or many forms. The reader can comprise a point of sale terminal, a kiosk, or other type of device. If the three dimensional stored value token comprises a plurality of machine-readable codes 120, such as illustrated in FIGS. 8 and 9 described above, each machine-readable code 120 can be presented to the reader or only a single code 120 need to be presented if the plurality of codes 120 are logically related to one another in a back-end database.

In step 1527, the one or more codes 120 can be scanned by the reader. In optional step 1530 illustrated with dashed lines, value in the form of a set or predetermined currency denomination can be added to a stored value account associated with the three dimensional stored value token 100 which is maintained in a back-end database. For example, the manufacturer of the stored value token 100 may establish that the token 100 can be sold at a value of a set amount such as, for example, twenty U.S. dollars. Once the reader scans the machine-readable code 120, then the selected (and exemplary) set value of twenty U.S. dollars can be added to the stored value account associated with the token 100.

Alternatively, in optional step 1533 illustrated with dashed lines, after scanning the machine-readable code 120, the reader may prompt the purchaser of the token 100 to select a desired amount of value to be associated with the token 100. For example, the purchaser of the token 100 could select to associate a value of one-hundred U.S. dollars to the token 100.

Next, in step 1536, the value of the three dimensional stored value token 100 can be displayed to the purchaser. In this step, the reader may present the value to the purchaser on an electronic display such as a terminal screen or a liquid crystal display (LCD).

In step 1539, payment corresponding to the value of the three dimensional stored value token 100 can be received. In step 1542, the three-dimensional container of the stored value token 100 can be opened so that the movable objects 125, such as consumer goods, can be removed. Next, in step 1545, the three-dimensional stored value token 100 can be presented and received as payment in a store for one or more goods and/or services.

Next, in step 1547, the machine readable code 120 positioned on the token 100 can be scanned by a reader. Subsequently, in step 1550, the value from the stored value account associated with the token 100 can be retrieved and exchanged for the one or more goods and/or services being purchased. In optional step 1553, additional value can be received from the purchaser or another person in order to add additional value to the stored value account associated with the three dimensional stored value token 100. Optional step 1553 allows the three dimensional stored value token to be re-charged for re-use. The process then ends.

Alternative embodiments for the three dimensional stored value token 100 will become apparent to one of ordinary skill in the art to which the invention pertains without departing from its spirit and scope. Thus, although this invention has been described in exemplary form with a certain degree of particularity, it should be understood that the present disclosure is made only by way of example and that numerous changes in the details of construction and the combination and arrangement of parts or steps may be resorted to without departing from the scope or spirit of the invention.

What is claimed is:

1. A stored value token comprising:

a three dimensional, rectangular shaped closeable volume, the closeable volume having a length, width, and a first thickness, the length being substantially greater than the width, the length and width being substantially greater than the first thickness, the closeable volume having first and second planar, two dimensional surfaces defined by the length and width, the closeable volume comprising human-perceivable media positioned on the first planar two dimensional surface, the closeable volume comprising machine-perceivable media encoded with information identifying a stored-value account positioned on the second planar two dimensional surface;

a movable cover for allowing access to the closeable volume, the movable cover being attached to the closeable volume by a hinge; and a plurality of substantially identical movable objects contained within the closeable volume, each movable object having one or more second thicknesses, the first thickness being greater than each second thickness.

2. The stored value token of claim 1, wherein each movable object comprises at least one of a plant seed, and an edible food stuff.

3. The stored value token of claim 1, wherein the movable cover comprises a triangular shape and the hinge comprises a seam.

4. The stored value token of claim 1, wherein the movable cover comprises a rectangular shape and the hinge comprises a portion of a wall forming the closeable volume.

5. The stored value token of claim 1, wherein the human-perceivable media comprises one of text and illustrations that suggest products which can be purchased with the stored value token.

6. The stored value token of claim 1, wherein the machine-perceivable media comprises one of a bar code, integrated circuit, a radio-frequency antenna, and a magnetic stripe.

7. The stored value token of claim 6, wherein the machine-perceivable code is formed on a label comprising an adhesive which couples the label to the second surface.

8. The stored value token of claim 1, wherein the human-perceivable media is formed on a label comprising an adhesive which couples the label to the first surface.

9. The stored value token of claim 1, wherein the first thickness has a magnitude that is one of greater than and equal to two times a magnitude of the second thickness.

10. The stored value token of claim 1, wherein the movable cover has a third thickness which has a magnitude that is less than a magnitude of the first thickness.

11. A stored value token comprising:

a three dimensional shaped closeable volume, the closeable volume having a length, width, and a first thickness, the length being substantially greater than the width, the length and width being substantially greater than the first thickness, the closeable volume having first and second two dimensional surfaces defined by the length and width, the closeable volume comprising human-perceivable media positioned on the first planar two dimensional surface, the closeable volume comprising machine-perceivable media encoded with information identifying a stored-value account positioned on the second planar two dimensional surface; the human-perceivable media comprises one of text and illustrations that suggest products which can be purchased with the stored value token; the machine-perceivable media comprises one of a bar code, integrated circuit, a radio-frequency antenna, and a magnetic stripe;

a movable cover for allowing access to the closeable volume, the movable cover being attached to the closeable volume by a hinge; and a plurality of substantially identical movable objects contained within the closeable volume, each movable object having variable second thicknesses, the first thickness being greater than each second thickness.

12. The stored value token of claim 11, wherein each movable object comprises at least one of a plant seed, and an edible food stuff.

13. The stored value token of claim 11, wherein the movable cover comprises a triangular shape and the hinge comprises a seam.

14. The stored value token of claim 11, wherein the movable cover comprises a rectangular shape and the hinge comprises a portion of a wall forming the closeable volume.

15. The stored value token of claim 11, wherein the machine-perceivable media is formed on a label comprising an adhesive which couples the label to the second surface.

16. The stored value token of claim 11, wherein the human-perceivable media is formed on a label comprising an adhesive which couples the label to the first surface.

17. The stored value token of claim 11, wherein the first thickness has a magnitude that is one of greater than and equal to two times a magnitude of the second thickness.

18. The stored value token of claim 11, wherein the movable cover has a third thickness that has a magnitude that is less than the first thickness.

19. The stored value token of claim 11, wherein the length comprises a magnitude of at least eighty-four millimeters and the width comprises a magnitude of at least fifty-three millimeters.

* * * * *